US005655787A

United States Patent [19]

Piegay

[11] Patent Number: 5,655,787

[45] Date of Patent: Aug. 12, 1997

[54] SKI WITH IMPROVED PROFILE

[75] Inventor: Yves Piegay, Meyrieu les Etangs, France

[73] Assignee: Skis Rossignol SA, Voiron, France

[21] Appl. No.: 644,963

[22] Filed: May 15, 1996

Related U.S. Application Data

[63] Continuation of Ser. No. 421,805, Apr. 13, 1995, abandoned.

[30] Foreign Application Priority Data

Apr. 15, 1994 [FR] France ..... 94 04824

[51] Int. Cl.[6] ..... A63C 5/06

[52] U.S. Cl. ..... 280/607; 280/617; 280/11.14

[58] Field of Search ..... 280/11.14, 11.15, 280/602, 607, 608, 611, 617, 618, 633, 636

[56] References Cited

U.S. PATENT DOCUMENTS

| | | | |
|---|---|---|---|
| 3,797,839 | 3/1974 | Smolka et al. | 280/617 |
| 3,797,844 | 3/1974 | Smolka et al. | 280/617 |
| 5,232,241 | 8/1993 | Knott et al. | 280/617 |
| 5,580,077 | 12/1996 | Dodge | 280/607 |

FOREIGN PATENT DOCUMENTS

| | | | |
|---|---|---|---|
| 2 689 772 | 10/1993 | France | 280/607 |
| 2 698 013 | 5/1994 | France | 280/617 |
| 2 701 854 | 9/1994 | France | 280/607 |

*Primary Examiner*—Brian L. Johnson
*Assistant Examiner*—Frank Vanaman
*Attorney, Agent, or Firm*—Harris Beach & Wilcox LLP

[57] ABSTRACT

A ski includes a running sole with a structural body comprising at least one upper reinforcement layer covered with an upper protective surface. In the region of the support face, an attached structure is fastened onto said upper surface at least in the rear part, that is, the zone intended to accommodate the heel binding which, in cooperation with a front toe stop, binds the boot of the skier. The heel binding is made from a sheet or plate of a viscoelastic material. The screws for fastening the anterior zone of the attached structure pass through the latter before being anchored in the upper reinforcement layer of the structural body. The screws for fastening the heel binding are anchored in the attached structure, above the sheet or plate of viscoelastic material. The attached structure is fastened in the posterior zone onto the structural body of the ski by means of the sheet or plate made of viscoelastic material.

4 Claims, 2 Drawing Sheets

SKI WITH IMPROVED PROFILE

This is a continuation of application Ser. No. 08/421,805, filed on Apr. 13, 1995, now abandoned.

FIELD OF THE INVENTION

The invention relates to a ski, the skiing comfort of which is intended to be improved, in particular, by decreasing the vibrations generated during skiing as well as by the reactions inherent in the mechanical characteristics of the ski itself.

BACKGROUND AND SUMMARY OF THE INVENTION

Document U.S. Pat. No. 5,232,241 describes a ski in which the upper face has a recess intended to accommodate a plate on which the bindings, namely the front toe stop and the rear heel binding, are fastened. Advantageously, this document provides for a sheet made of a viscoelastic material to be interposed at the interface between the plate accommodating the binding and the ski proper, so as to allow, on the one hand, absorption of disruptive vibrations and, on the other hand, to allow this ski relatively wide-amplitude flexion movements, by virtue of the elimination, or in any case the reduction in the effects of rigidity generated by traditional binding devices. However, in view of the fact that the toe stop and the heel binding are fastened only at this attached plate, and by virtue of the presence of this viscoelastic material, the accuracy of controlling the ski is significantly affected, to the extent of reaching some degree of "floating" of the binding-support plate, which is in any case incompatible with a precision ski and, a fortiori, competition skiing.

The current structure of skis tends toward narrowing of the zone of the support face, which results in an increased risk of the sides of the shoe, which are thus markedly wider than this zone, touching the ground instead of the edges during turning. This risk leads to slipping of the ski, that is to say abrupt detachment thereof from the surface of the snow.

In order to overcome this risk, it is proposed to raise the zone of the support face, that is to say the zone accommodating the bindings, with respect to the upper plane of the ski, for example by means of wedges or plates screwed or adhesively bonded onto the upper surface of the ski.

For example, document U.S. Pat. No. 2,550,002 describes such a ski in which the zone used for mounting the bindings is raised by a wooden plate with the interposition, between the plate and the upper surface of the ski, of a rubber strip. However, in this case the accuracy of controlling the ski is still significantly affected, in view of the floating of the binding-support plate with respect to the ski itself.

It has also been proposed, for example in document FR-A-2,648,720, to produce a ski which has a raised upper wall in the zone of the support face, for incorporating a plate made of viscoelastic material into this zone. However, vibration isolation is not optimal in such a structure.

In parallel, such systems may be envisaged with a ski having a more complex profile, of which the evolution is constantly increasing and for which there is a growing public demand.

The object of the invention is to provide a ski of the type in question, which overcomes these various drawbacks.

The invention provides a ski comprising:

a running sole, optionally bordered by edges, a structural body comprising at least one upper reinforcement layer covered with an upper protective surface, in the zone of the support face, an attached structure, fastened onto said upper surface by means of a sheet or plate made of a viscoelastic material, at least in the rear part, that is to say in the zone intended to accommodate the heel binding which, in cooperation with a toe stop, binds the boot of the skier.

In the ski according to the invention:

the screws for fastening the anterior zone of the attached structure pass through the latter before being anchored in the upper reinforcement layer of the structural body;

the posterior zone of the attached structure is fixed by adhesive bonding onto the structural body of the ski by means of the sheet or plate made of viscoelastic material;

the screws for fastening the heel binding are anchored in the attached structure, above the sheet or plate made of viscoelastic material.

In this way, it is thus possible to combine, on the one hand, the damping effect of the viscoelastic material, operating either by compression or by shearing, with the function of accurate guiding of the ski using the front toe stop. Further, in view of the shear capacity imparted to the posterior zone of the attached structure by virtue of the presence, where it is fastened onto the structural body of the ski, of a sheet or plate made of viscoelastic material, the entire binding (front toe stop+heel binding) is never compressed, even when the ski bends.

Advantageously, the attached structure has an upper surface extending the general shape of the upper surface of the ski. This means that no notable discontinuity is observed in the profile of the ski, after said attached structure has been fitted, this being true both in the longitudinal direction and in the transverse direction of the ski.

Advantageously, the toe stop and the heel binding are held substantially parallel to the running sole by means of elements which are attached onto said structure and have a suitable complementary shape for matching the particular profile of this structure, in particular when the latter has an overall triangular cross section.

The manner in which the invention may be embodied and the advantages which result therefrom will emerge better from the exemplary embodiments which follow, given by way of indication and without limitation being implied, supported by the attached figures.

DETAILED DESCRIPTION OF A PREFERRED EMBODIMENT

Figure 1:
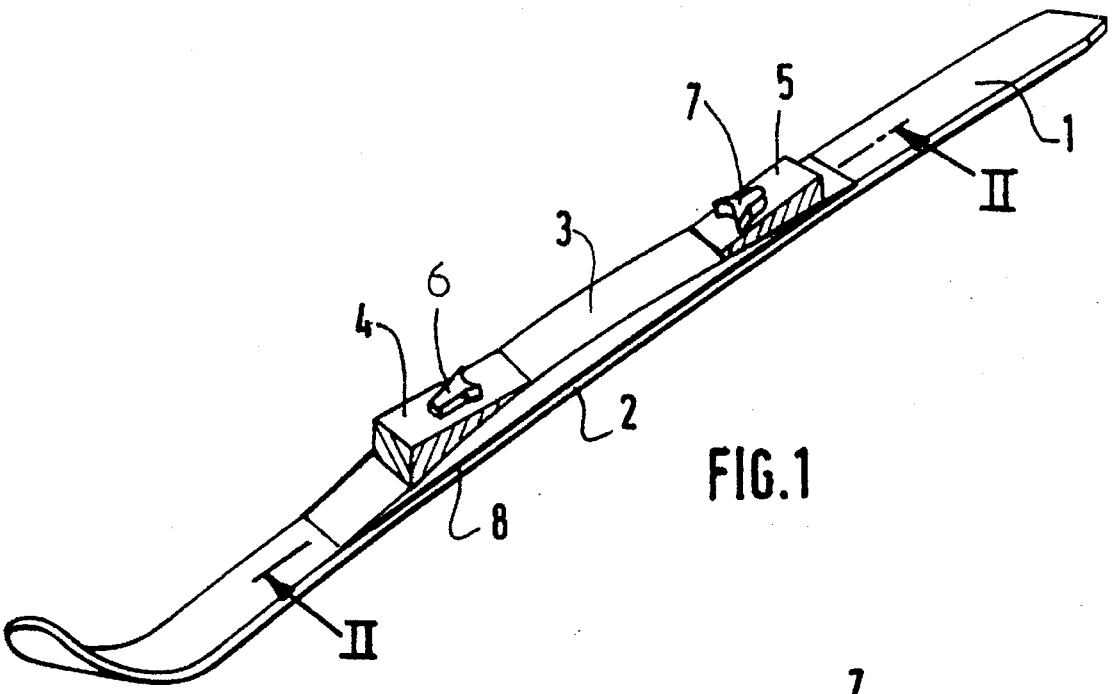
FIG. 1 is a schematic perspective representation of a ski according to the invention.

FIG. 1 very schematically represents a ski (1) of traditional profile, which comprises, in the region of the support face (2), a structure (3) attached onto the upper face of said ski in the region of this support face. This ski further comprises a running sole (13), bordered by metallic lateral edges (16), the running sole subassembly thus produced being covered with a reinforcement element (12). Further, the ski represented also Comprises lateral sides (17), for example made of ABS (acrylonitrile/butadiene/styrene).

Figure 2:
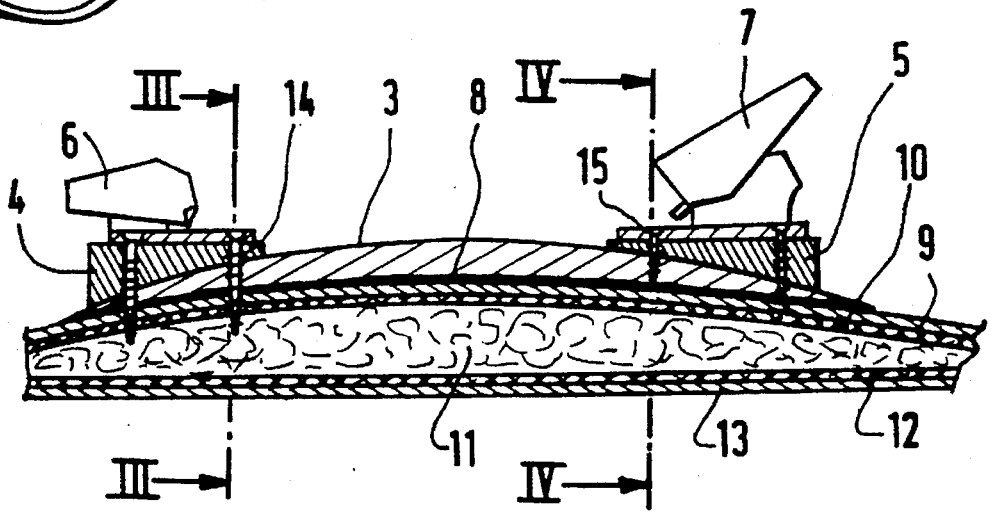
FIG. 2 is a partial representation in longitudinal section along the line II—II in FIG. 1, in particular of the zone of the support face of the ski according to the invention.
Figure 3:
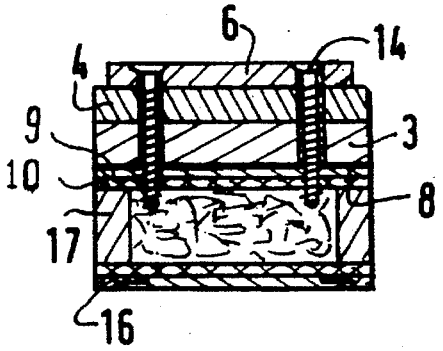
FIGS. 3 and 4 respectively referring to sections along lines III—III and IV—IV are schematic representations in cross section of a ski, on the one hand in the region of the front toe stop along the line III—III in FIG. 2 and, on the other hand, in the region of the heel binding along the line IV—IV in said FIG. 2.
Figure 4:
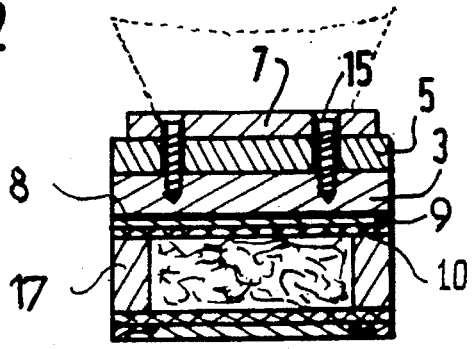

More specifically, the structure (3), one embodiment of which has been represented in FIGS. 2, 3 and 4, is, for example, made of wood, of molded plastic, or else using a more complex structure. Further, although represented in monobloc form in the figures, this attached structure (3) may consist of two parts, respectively an anterior part and a posterior part.

A sheet or plate (8) of a viscoelastic material is interposed between the structure (3) and the upper face (9) of the ski (1). It should be noted that, although in the examples described in conjunction with the figures, this sheet or plate made of viscoelastic material extends over the entire length of the attached structure (3), said sheet (8) may be limited to the posterior zone of the attached structure (3) alone, that is to say to the region of the fastening zone of the heel binding (7).

The structure (3), which may be of variable profile, accommodates two respective elements (4) and (5) in line with the site where the binding, namely the front toe stop (6) and the heel binding (7), is fitted. These elements (4) and (5), for example made of polyurethane, are intended to allow positioning of the said binding in a plane parallel to the running sole in the region of the support face (2). They are fastened onto the structure (3) by means of anchoring screws or an equivalent system (14, 15) (FIGS. 3 and 4).

According to one feature of the invention, the fastening of the toe stop (6) onto the element (4) in the region of the structure (3) using the screws (14) is anchored more deeply than the structure (3) itself, because it is anchored in the region of the upper zone of the ski (1), as is clearly seen in FIG. 3, by passing through the viscoelastic plate (8) then the protective sheet of the upper surface of the ski, which furthermore acts as decoration (9), before being screwed into the upper reinforcement element (10) and into the core (11) constituting the center of the structural body of the ski.

In contrast, the heel binding (7) fixed onto the element (5) is anchored only in the region of the structure (3) as can be better seen in FIG. 4, and therefore without reaching the protection sheet (9) of the upper surface of the ski, and a fortiori without reaching the structural body of said ski.

In this way, the structure (3) is isolated from the body of the ski by the presence of the plate of viscoelastic material (8), so that a large proportion of the vibrations are absorbed by this material and are not transmitted to the skier.

On the other hand, by virtue of the deep anchoring of the front toe stop (6) by means of the screws (14) in the region of the upper face of the ski (9) and of the reinforcement (10), greater accuracy is thereby provided in controlling the ski, in particular when turning.

Thus, the posterior zone of the attached structure (3) is fixed by adhesive bonding onto the upper face of the viscoelastic sheet or plate (8), which is itself adhesively bonded via its lower surface onto the structural body of the ski. In this way, the heel binding, fixed in line with this zone only onto the attached structure, can permit the occurrence of shearing by virtue of the viscoelastic sheet (8).

Figure 5:
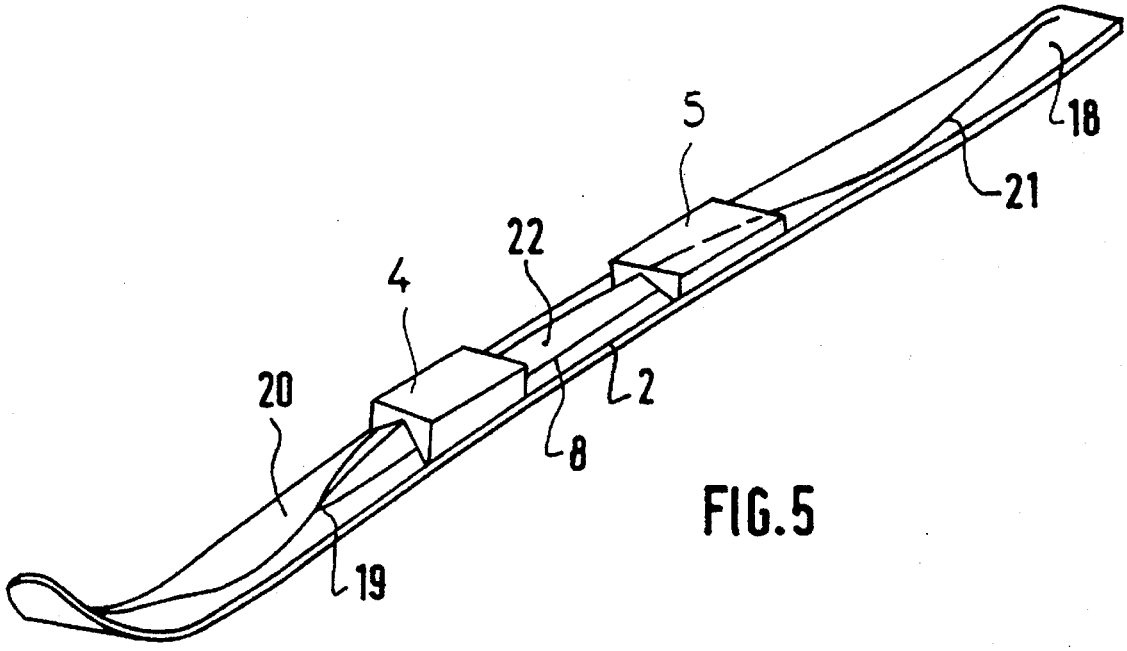
FIG. 5 is a schematic perspective representation of a ski having a particular profile according to the invention.
Figure 6:
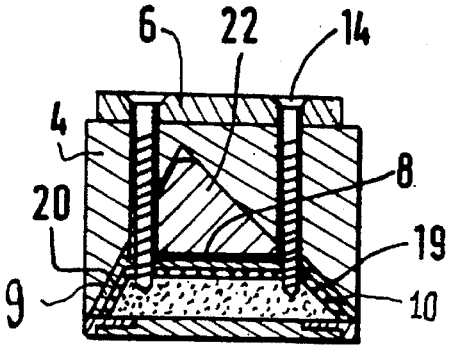
FIG. 6 is a schematic representation in cross section showing the from toe stop of FIG. 5.
Figure 7:
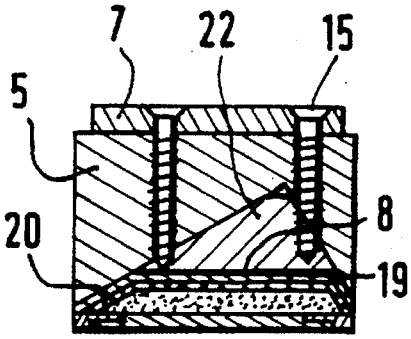
FIG. 7 is a schematic representation in cross section showing the heel binding of FIG. 5.

FIGS. 5 to 7 represent another embodiment of the invention, in which the profile of the ski (18) is not traditional as represented in FIG. 1, but is complex and, in particular, has a triangular cross section which varies over the entire length of the ski.

The profile of the upper surface of this ski (18) forms two inclined surfaces (19, 20), the inclination of which varies over the length of the ski, the said inclined surfaces joining to form an upper ridge (21). In the region of the support face, as can be seen in FIGS. 6 and 7, the cross section of the ski is substantially trapezoidal, and is surmounted by an attached structure (22) of triangular cross section, which extends the shape of the sides of the trapezoidal cross section, so as to give the ski a continuous triangular profile which is free of shape discontinuities.

In the zone of the support face, the ski accommodates, between its upper face, consisting of the short base of the trapezoidal cross section, and the attached structure (22), a band (8) made of a viscoelastic material.

In this way, and in these cases, the elements (4) and (5) have a shape suited and complementary to the profile in question, so as to hold the front toe stop (6) and the heel binding (7), respectively, in the same plane parallel to the running sole in the region of the support face.

The fastening mode remains equivalent, i.e. deep anchoring of the screws (14) passing through the element (4) accommodating the front toe stop (6), inside the upper face of the ski (18), and in particular in the region of the reinforcement (10), and limited anchoring of the screws (15) passing through the support element (5) for the heel binding (7), only inside the attached structure (22), in order to allow the shear phenomena in this region.

In addition to the advantages already developed in the context of the description of the exemplary embodiment relating to FIGS. 1 to 4, this particular embodiment makes it possible to obtain good lateral guiding of the intermediate elements (4, 5), and thereby of the front toe stop (6) and of the heel binding (7), with respect to the longitudinal axis of the ski, this guiding virtually being optimized by the particular rib-shaped profile of the ski, which results in closer cooperation between said elements (4, 5) and the upper surface of the ski.

I claim:

1. A ski comprising:

a running sole;

a structural body connected to the sole comprising at least one upper reinforcement layer covered with an upper protective surface and a core;

in a region of a support face of the ski, an attached structure fastened onto said upper protective surface at least in a rear part of said attached structure, the rear part constructed to receive a heel binding which, in cooperation with a front toe stop, binds a boot of a skier;

a sheet made of a viscoelastic material between said structural body and said attached structure wherein:

first screws for fastening a toe binding pass through the attached structure before being anchored in the core of the ski so that said toe binding is rigidly attached to said core;

a posterior zone of the, attached structure is fastened by adhesive bonding onto the structural body of the ski by means of said sheet of viscoelastic material; and, second screws for fastening the heel binding are anchored only in the attached structure above said sheet made of viscoelastic material.

2. The ski as recited in claim 1, wherein said from toe stop and said heel binding are held substantially parallel to the running sole by means of intermediate elements attached to said attached structure and having a shape constructed to match a particular profile of the attached structure.

3. The ski as recited in claim 2, wherein the ski has an upper surface, said profile of the attached structure extends the upper surface of the ski so as to form a continuous profile.

4. The ski as recited in claim 1, wherein the ski has an upper surface, said upper surface forming a continuous profile.

* * * * *